US007477153B2

(12) United States Patent
Gruteser et al.

(10) Patent No.: US 7,477,153 B2
(45) Date of Patent: Jan. 13, 2009

(54) SYSTEM FOR WIRELESS MOBILE SEATING PLATFORM

(75) Inventors: Marco O. Gruteser, Yorktown Heights, NY (US); Anthony Levas, Yorktown Heights, NY (US); Herbert Scott McFaddin, Yorktown Heights, NY (US); Paul Andrew Moskowitz, Yorktown Heights, NY (US); Danny Chan Yong Wong, Allendale, NJ (US)

(73) Assignee: International Business Machines Corporation, Armonk, NY (US)

( * ) Notice: Subject to any disclaimer, the term of this patent is extended or adjusted under 35 U.S.C. 154(b) by 892 days.

(21) Appl. No.: 11/001,141

(22) Filed: Dec. 2, 2004

(65) Prior Publication Data

US 2005/0093696 A1 May 5, 2005

Related U.S. Application Data

(62) Division of application No. 09/917,822, filed on Jul. 31, 2001, now Pat. No. 6,870,477.

(51) Int. Cl.
*G08B 23/00* (2006.01)

(52) U.S. Cl. ..... 340/573.1

(58) Field of Classification Search ..... 340/573.1, 340/500, 539.1, 3.1, 825.69, 825.19, 582, 340/667; 165/200; 236/1 B
See application file for complete search history.

(56) References Cited

U.S. PATENT DOCUMENTS 3,418,552 A 12/1968 Holmes
4,180,062 A 12/1979 Alberti et al.
4,942,352 A 7/1990 Sano
5,113,176 A 5/1992 Harris
5,172,056 A 12/1992 Voisin
5,404,128 A 4/1995 Ogino et al.
5,536,026 A 7/1996 Pozzobon et al.
5,544,649 A 8/1996 David et al.
5,630,566 A 5/1997 Case
5,818,132 A 10/1998 Konotchick
5,936,380 A 8/1999 Parrish
5,961,561 A 10/1999 Wakefield, II
6,080,106 A 6/2000 Lloyd et al.
6,163,249 A 12/2000 Betcher, III
6,191,796 B1 2/2001 Tarr
6,204,767 B1 3/2001 Sparks
6,220,382 B1 4/2001 Kramer, Jr. et al.
6,255,956 B1 7/2001 Tingley et al.
6,287,253 B1 9/2001 Ortega et al.
6,348,867 B1 2/2002 Myllymaki
2003/0229447 A1 * 12/2003 Wheatley et al. ..... 701/300
2005/0030188 A1 * 2/2005 Flanagan et al. ..... 340/667

* cited by examiner

*Primary Examiner*—Phung Nguyen
(74) *Attorney, Agent, or Firm*—McGinn IP Law Group, PLLC; Stephen C. Kaufman

(57) ABSTRACT

A system includes a mobile seating platform, a wireless communications system embedded within the seating platform, and a haptic system embedded in the seating platform. The haptic system includes a plurality of vibrators disposed at a plurality of positions in the seating platform for communicating information to the occupant of the seating platform and a plurality of deformable surfaces disposed at a plurality of positions in the seating platform for communicating information to the occupant of the seating platform.

1 Claim, 3 Drawing Sheets

SYSTEM FOR WIRELESS MOBILE SEATING PLATFORM

The present application is a Divisional Application of U.S. patent application Ser. No. 09/917,822 filed on Jul. 31, 2001, now U.S. Pat. No. 6,870,477.

BACKGROUND OF THE INVENTION

1. Field of the Invention

The present invention generally relates to a seating platform, or chair, and more particularly to a freely movable chair which includes electronic devices for sensing, communications and a wireless power supply for providing energy to the chair.

2. Description of the Related Art

Chairs and other similar seating platforms are pervasive. There are perhaps ten chairs for each individual in North America. Chairs are an ideal device for sensing information about occupants of the chair, in an office for example, and for sending and receiving information to computing systems. Typically chairs in such an environment are free to move. Input/output systems that depend on wires are ruled out. Devices built into chairs must have a source of energy. Again, wired energy sources are ruled out.

It has been recognized that chairs may serve as platforms for electronics. See, for example, U.S. Pat. No. 6,220,382 "Powered wheelchair with separating frame" issued to Karamer, Jr. et al., U.S. Pat. No. 4,180,062 "Portable childbirth chair with electronic monitoring apparatus" issued to Alberti et al., U.S. Pat. No. 5,961,561 "Method and apparatus for remote maintenance, troubleshooting, and repair of a motorized wheelchair" issued to Wakefield, II, and U.S. Pat. No. 5,630,566 "Portable ergonomic work station" issued to Case, each incorporated herein by reference.

It has been also recognized that chairs equipped with electronic devices require a source of electrical energy. However, the solutions provided (e.g., to equip the chair with heavy and space consuming batteries, or to attach wired sources of energy to the chair) pose their own drawbacks. Batteries must be recharged by plugging them into power sources or they must be replaced periodically. Further, connecting the chair to a source of electrical power limits its mobility. By the same token, replacing batteries is inconvenient and expensive.

It has also been recognized that sensors may be used to monitor the occupation of a chair. See, for example, U.S. Pat. No. 6,204,767 "Chair monitor" issued to Sparks, incorporated herein by reference.

However, it has not been recognized that wireless systems may be used to provide communications for the chair to a computing system in order to activate effectors to change the environment in which the chair is found. Further, it has not been recognized that a wireless connection between the chair and a computing network may be used to inform others of the state of occupation of the chair.

SUMMARY OF THE INVENTION

In view of the foregoing and other problems, drawbacks, and disadvantages of the conventional methods and structures, an object of the present invention is to provide a seating platform with an electronic mechanism for sensing the occupation of the chair, transmitting an indication of the occupation wirelessly to a computing system, and further providing a unit for the computing system to actuate effectors to change the environment of the chair.

It is also an object of this invention to provide a connection unit for connecting the electronically equipped chair to a network so that information about the state of the chair and its occupant may be relayed to others at distant locations.

It is also an object of this invention to provide a means for determining that a particular occupant has occupied the chair and whether that occupant is a human or a non-human (e.g., a dog or a cat).

Further, it is an object of this invention to provide a wireless unit for providing energy to the electronics carried by the chair so as to allow the chair to remain mobile without the need for wired connections.

It is also an object of this invention to eliminate the need for the replacement of batteries that may be used to supply energy to the chair devices.

In a first aspect of the present invention, a system includes a seating platform, a communications system embedded within the seating platform for receiving an information carrying communication from a remote system, and a haptic system embedded in the seating platform for communicating information carried by the information carrying communication to an occupant of the seating platform, wherein the haptic system includes one of at least one vibrator and a deformable surface, wherein the communications system includes a wireless communications system, wherein the seating platform is mobile, wherein the haptic system includes a plurality of vibrators disposed at a plurality of positions in the seating platform for communicating information to the occupant of the seating platform, wherein the haptic system includes a plurality of deformable surfaces disposed at a plurality of positions in the seating platform for communicating information to the occupant of the seating platform, wherein the haptic system includes a plurality of vibrators disposed at a plurality of positions in the seating platform, and a plurality of deformable surfaces disposed at a plurality of positions in the seating platform, the plurality of vibrators and the plurality of deformable surfaces for communicating information to the occupant of the seating platform, wherein a predetermined combination of the plurality of vibrators communicates information to the occupant, wherein a predetermined combination of the plurality of deformable surfaces communicates information to the occupant, and wherein a predetermined combination of the plurality of vibrators and the plurality of deformable surfaces communicates information to the occupant.

With the invention, the seating platform senses the occupation of the chair, transmits an indication of the occupation Tirelessly to a computing system, and enables the computing system to actuate effectors to change the environment of the chair. Additionally, the electronically-equipped chair can be connected to a network so that information about the state of the chair and its occupant may be relayed to others at distant locations. Moreover, energy is provided to the electronics carried by the chair so as to allow the chair to remain mobile without the need for wired connections. Additionally, the invention eliminates the need for replacement of batteries that may be used to supply energy to the chair devices.

BRIEF DESCRIPTION OF THE DRAWINGS

The foregoing and other purposes, aspects and advantages will be better understood from the following detailed description of a preferred embodiment of the invention with reference to the drawings, in which.

DETAILED DESCRIPTION OF PREFERRED EMBODIMENTS OF THE INVENTION

Figure 1:
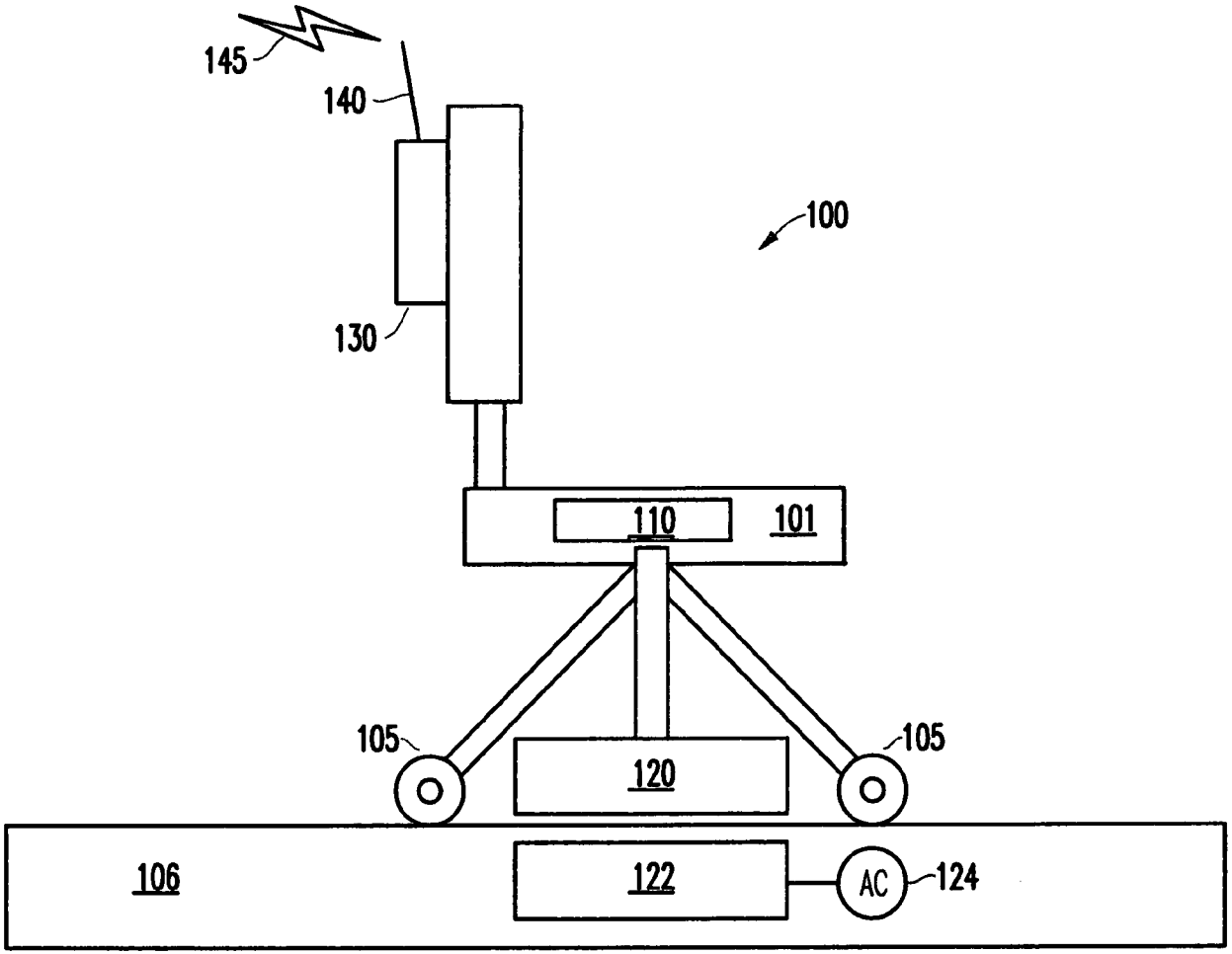
FIG. 1 is a diagram of an apparatus for a mobile wireless chair 100.
Figure 2:
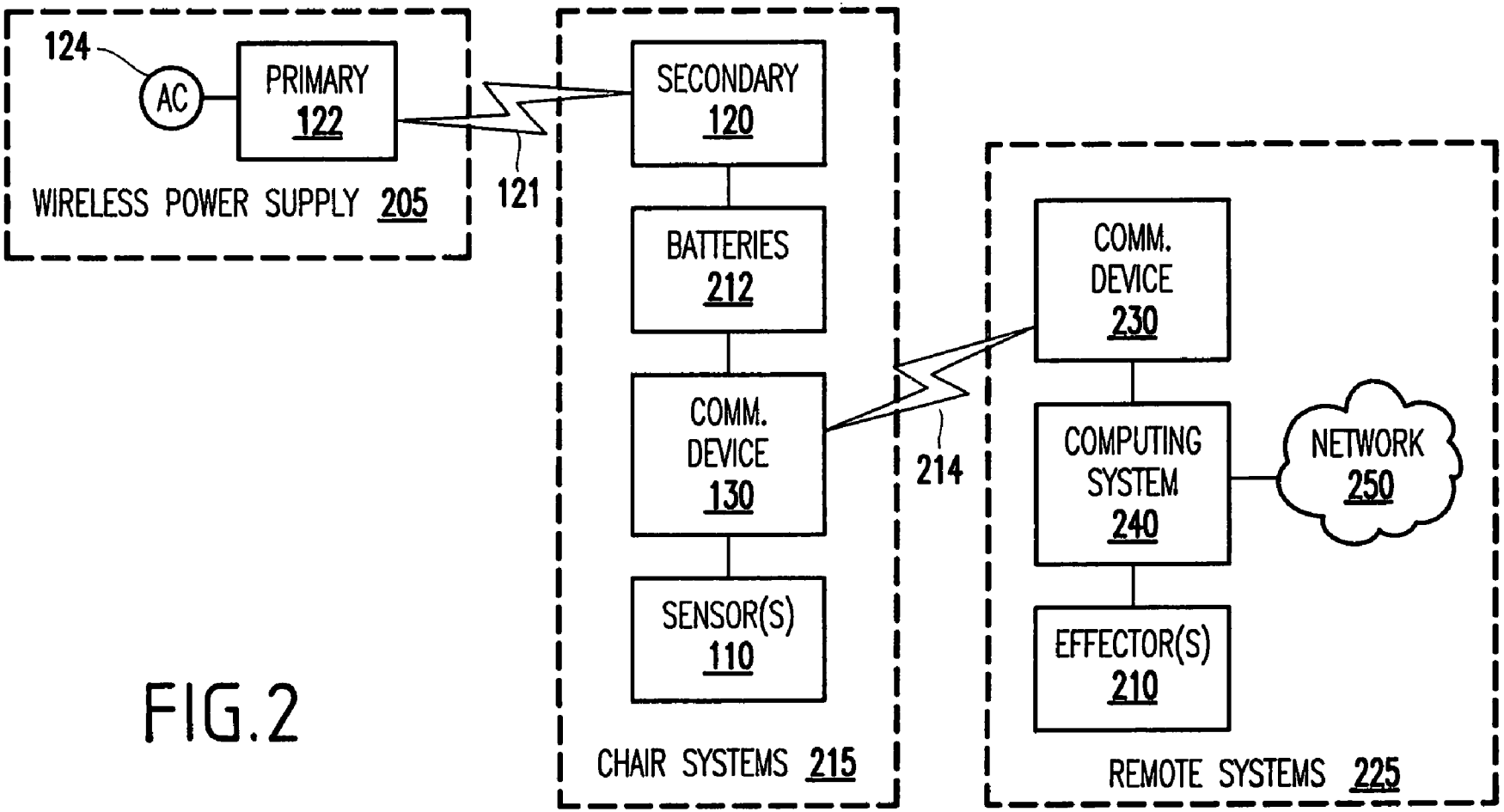
FIG. 2 is a system diagram for a wireless power supply 205, chair systems 215, and remote systems 225 associated with the chair 100 of FIG. 1.
Figure 3:
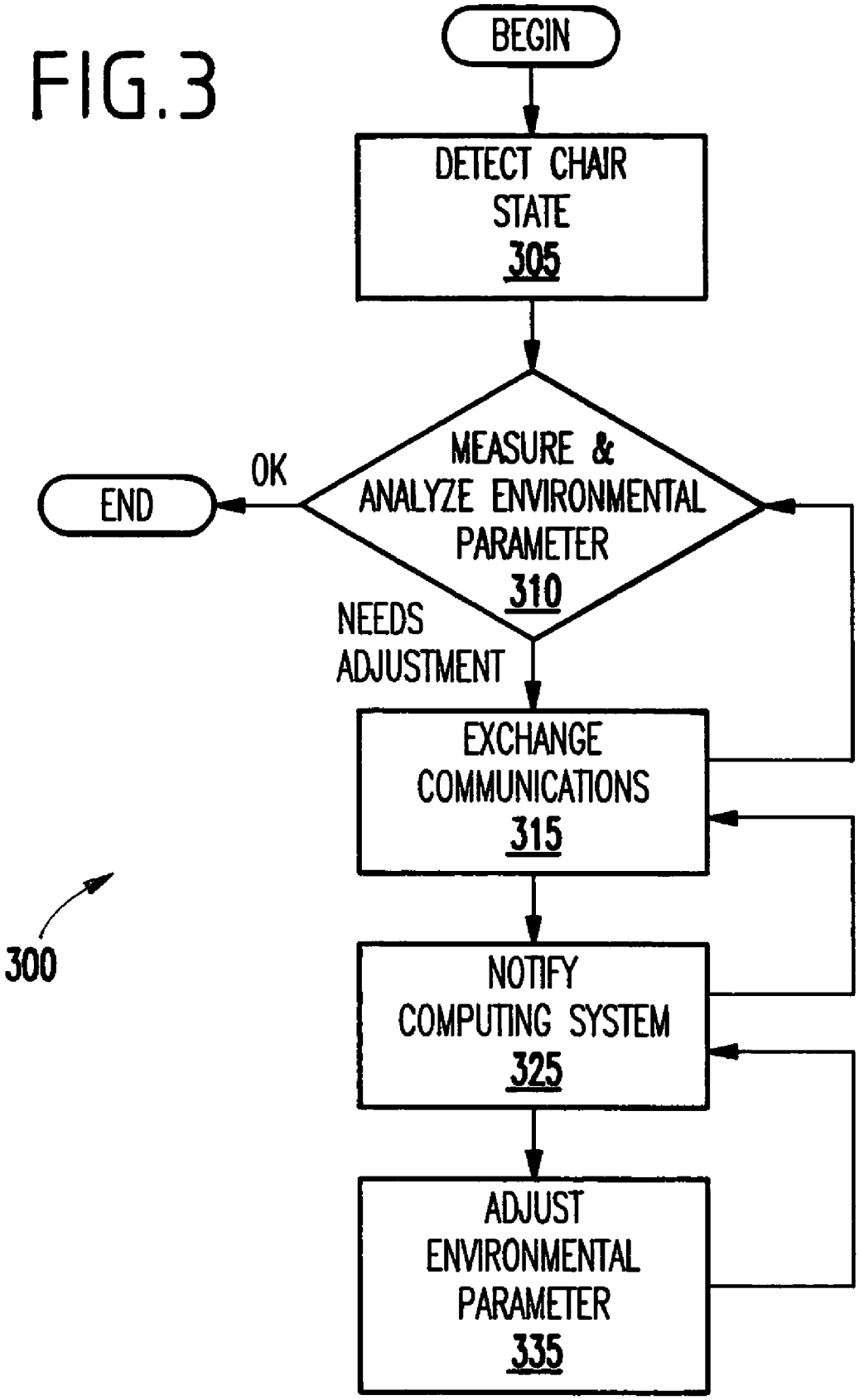
FIG. 3 is a flowchart of a method 300 of using the wireless chair and remote systems according to the present invention.

Referring now to the drawings, and more particularly to FIGS. 1-3, there are shown preferred embodiments of the method and structures according to the present invention.

Preferred Embodiment

Referring to FIG. 1, an apparatus 100 for a wireless mobile seating platform is shown. The seating platform (e.g., chair 101) rests on a floor 106. Although the term "chair" is used in a preferred embodiment, it is understood that the invention refers to any seating platform including a chair, a sofa, a stool, a wheelchair, etc. The seating platform may be located in a business, a home, a restaurant, or in a public space such as an airport.

The floor may be of a conventional variety or may be a raised platform as is frequently used in offices and laboratories. The floor may be carpeted or non-carpeted, tiled or non-tiled, etc. The chair 101 is equipped with wheels 105 so that it may be moved easily from one seating location to another. Although the wheels are not a necessity, chairs with wheels are often used in offices or are used by people with disabilities.

The chair 101 is also equipped with at least one sensor 110 to determine whether the chair is occupied. The sensor 110 may function by detecting weight, pressure, or may simply comprise an on/off switch that is activated when it is sensed that a person occupies the chair. The weight sensor may be used to distinguish one person from another.

Another sensor that may be employed to detect the presence of a person is a heartbeat sensor. U.S. Pat. No. 5,404,128, incorporated herein by reference, describes the detection of a being based upon the life activity of the human body including a heartbeat. Such a system using the distinguishing characteristics of a heartbeat (e.g., rate, shape, QRS complex, etc.) may also be used to distinguish humans from non-humans. Thus, the occupation of the chair by a non-human (e.g., dog, cat, etc.), may be distinguished from that of a human by means of sensed physical characteristics of the occupant including heartbeat characteristics and weight. The weight sensor may be used to distinguish dogs and cats from humans or to distinguish between particular human occupants. Companion animals, dogs, cats, etc., often occupy the chairs of humans. It is useful to be able to distinguish these non-humans from humans so that their presence does not trigger automated functions designed for humans. The heartbeat sensor also may help to distinguish different individuals. Additionally, the heartbeat sensor may be used to distinguish between living beings, e.g. humans and cats, and inanimate objects, e.g. a package placed on the chair. Thus, information about the state of occupation of the chair, whether the occupant is a person or an animal, and who the person is may be derived from sensor information.

The sensor information may be used to determine the length of time that an occupant has been seated. Long durations of sitting in the same position may lead to physical problems in people effecting circulation, the formation of blood clots, and nerve damage caused by repetitive motion injury. Once a person has been seated longer than a specified time, a warning may be issued using one of the systems described. The warning may be displayed by the external systems or sent as a communication to the seating platform. The warning may include a message stating the length of time that the occupant has occupied the seating platform or that the occupant has occupied the seating platform for an excessive length of time, or that physical injuries may be incurred by the occupant as a result.

Other sensors may be employed to detect the position and orientation of the chair. U.S. Pat. No. 5,172, 056, issued to Voison, incorporated herein by reference, describes an apparatus for determining object orientation and position. This system uses a sensor system placed in the object and externally placed magnetic field coils. This system, useful for helmet-type viewfinders, is wireless and may be adapted for use with a wireless seating platform. Information on the position and orientation of the chair may be used to control environmental parameters such as the state of a lighting system. Lights can be illuminated in the vicinity of the chair or in the vicinity of the area in which the chair is facing. Thus, a description of the state of the chair may include the position and orientation of the chair. Additionally using this system, the orientation and position of the chair may be sensed over a period of time. By comparing the orientation and position deduced at two different times, the movement of the chair is also effectively sensed and may be included in a description of the state of the chair.

The sensor (or more preferably a plurality of sensors) 110 is electrically connected to a communications device 130. The device 130 has a radiating antenna 140 and may communicate by wireless media (and means) 145. The wireless communication device is enabled to use one of several standard protocols for wireless communications. The standard wireless protocols are typically infrared, or radio communication protocols.

In an infrared embodiment, the wireless technology used can be an Infrared Data Association (IrDA) protocol, such as IrDA-Data, IrDA Control, AIr, or the like. The Infrared Data Association was founded as a nonprofit organization in 1993, and is an international organization that creates and promotes interoperable, low cost infrared data interconnection standards that support a walk-up, point-to-point user model. The standards support a broad range of appliances, computing and communications devices. IrDA has a large number of international companies as members.

The preferred embodiment for radio communication is Bluetooth technology. Bluetooth is a wireless technology from the Bluetooth Special Interest Group. The official specifications are found on the www.bluetooth.com web site. Bluetooth is an open standard for short-range transmission of digital voice and data between mobile devices (laptops, PDAs, phones, etc.) and desktop devices. It supports point-to-point and multipoint applications.

The Bluetooth radio is built into a small microchip and operates in a globally available frequency band ensuring communication compatibility worldwide. The Bluetooth microchip, incorporating a radio transceiver, is built into digital devices. The Bluetooth technology makes all connections quickly and without the need for cable. The radio operates in a globally available frequency band, ensuring compatibility worldwide. Bluetooth facilitates fast and secure transmission of both voice and data, even when the devices are not within line of sight.

Another radio wireless mechanism of communication is the iBean radio transmitter and receiver manufactured by the Millennial Net Company of Cambridge, Mass. Other wireless mechanisms that may be used include cellular telephone communication, or communications by means of the IEEE 802.11 standard for wireless networking.

The devices, sensors, wireless communication devices, etc. of the chair 101 generally require electrical energy in order to operate. In order not to restrict the movement of the chair by wired connections, a wireless method/mechanism of transferring electrical energy to chair may be used. The chair is positioned over a power source that is associated with the floor, e.g. embedded in or placed on the floor 106. The power source includes a source of alternating current 124, and a primary transformer 122.

A secondary transformer and dc power supply 120 is attached to, and positioned near, the floor below the chair. Although there is no physical contact, electrical energy is inductively coupled between the primary contained in 122 and the secondary contained in 120. Designs for such non-contact power supply systems are described in U.S. Pat. No. 3,418,552 "Separable transformer battery charger" issued to Holmes, and U.S. Pat. No. 4,942,352 "Non-contacting power supplying system" issued to Sano, each herein incorporated by reference.

The primary of the inductively coupled transformer of the power supply may be embedded in the floor, placed below a raised floor, or placed on top of the floor in the form of a flat coil. The electrical energy delivered to the seating platform may be used to directly power the platform's electronic devices or it may be stored in batteries 212 of FIG. 2.

Other means are available for providing the seating platform with electrical energy without the need for wires. Solar cells may be positioned in the external surfaces of the platform. The use of solar cells to power an electronic device is shown in U.S. Pat. No. 5,936,380 entitled "Alternative power for a portable computer via solar cells" issued to Parrish, incorporated herein by reference.

Further, the movement of the person in the chair may be used to generate electricity. Such movement occurs when the chair occupant leans back or forward causing the elements of the chair to move with respect to each other. A means for producing electricity based upon the linear motion of elements is described in U.S. Pat. No. 5,818,132 entitled "Linear electric power supply generator" issued to Konotchick, herein incorporated by reference. The motion of the chair, and in particular the rotational motion of the wheels 105 of the chair may be used to generate electricity. See, for example, U.S. Pat. No. 5,536,026 entitled "Power generator device for wheeled sport implements" issued to Pozzobon et al., herein incorporated by reference.

FIG. 2 is a block diagram illustrating the major subsystems of the invention.

The wireless power supply 205 and the on-board chair systems 215 have been described above. The power supply primary 122 is inductively (wireless) coupled 121 to the power supply secondary 120. The chair is coupled by a wireless communications device 130 to remote systems 225. The remote systems 225 may be located on the same premises with the chair or may be a considerable distance away.

When an occupant is detected in the chair, as described above, a wireless signal 214 is sent by the chair-based communications device 130 to a remote communications device 230. The signal contains information about the state of the chair and the occupant of the chair. Such information is received by a computing system 240 which issues instructions to effectors 210. The effectors may be used to control the environmental parameters of the chair by controlling the parameters or characteristics of lighting, (e.g., on, off, intensity, etc.) heating, ventilation arid air conditioning, HVAC, (e.g., temperature, humidity, air flow, etc.), and displays (e.g., on, off, type of information displayed), etc.

The information relayed to the computing system 240 from the sensor(s) 110 may be used to identify the occupant of the chair. This information may be relayed in turn to other computing systems by a network 250. The network 250 may be the Internet, an intranet, a Bluetooth network, an IEEE 802.11 network, or a Local Area Network (LAN). The information conveyed to the network and in turn to other computing systems may be used, for example, by other employees at a place of business to determine whether a particular employee is located in the seating platform.

The chair systems 215 may also include effectors (not shown) to control various aspects of the chair. For instance if the information contained in the signal indicates that a person of a particular weight occupies the chair, the effectors in the chair may be signaled by the communications devices to adjust the ergonomic settings of the chair. The chair systems 215 may also include a computing device, such as a personal computer, PC, which is used to control the other devices. The PC may have a user interface including input devices and displays which may be used by the occupant of the chair to make manual adjustments to environmental parameters and which may also convey information to the occupant about the status or results of information carrying signals sent from or received by the chair systems. The PC may also have speech recognition capabilities, such as may be provided by the IBM ViaVoice® software package, to allow an occupant to input voice commands.

Additionally, the chair may be equipped with haptic user interface devices. Haptic devices are those which communicate with the user (the chair occupant) through the sense of touch. Such devices may communicate with a person seated in the chair by deforming the seat or back of the chair, Deformable haptic devices are described in U.S. Pat. No. 6,191,796, incorporated herein by reference. Another haptic device is a vibrator. Such devices may be used to convey information to the occupant.

For example, by adding a set of vibrators in different locations in a chair, the current occupant may be haptically notified of various events such as an incoming phone call, arrival of e-mail or signaling time to go to a meeting. By placing a set of such devices in an appropriate configuration, (e.g., such as an array in the seat cushion or seat back), and by varying the vibration intensity of each vibrator in a specified sequence over time, one can create the sensation of motion.

That is, the human occupant perceives the point of vibration on the seat back as movement on the occupant's body. By creating a variety of such patterns of stimulation and associating them with relevant notification events, the computer system can silently inform the occupant of various events. For example, perceived vibrating motion going from the top of the seat back towards the bottom of the seat back could silently signal an incoming phone call, while motion from left to right on the seat cushion could signal e-mail arrival. Arbitrarily complex patterns of stimulation could be created silently signaling an arbitrarily large variety of events.

This is particularly useful for communicating with handicapped people (hearing impaired, or blind) if information that normally is delivered on the impaired modality is translated and delivered using haptic methods (e.g., phone or doorbell ringing). In addition, this is very useful for delivering information silently in situations when the recipient does not want others to know that they have received information or the nature of the message received. By controlling the path of the perceived motion one could create the illusion of "writing" characters on a person's body and could deliver textual messages in this manner.

Turning now to FIG. 3, a flowchart of the method 300 of operation of the invention and of using the wireless chair system 215 and remote systems 225, will be described.

First, in step 305, the state of the chair (either vacant, occupied, or occupied by a particular individual) is detected to initiate the process. This step may be initiated at regular time intervals or by a detected change in state. The state of the chair is a characteristic that may be sensed by the sensors previously described. Other characteristics may include whether the chair is occupied by a non-human (e.g., a dog or cat). In addition, the environmental parameters in the vicinity of the chair are characteristics that may be sensed or measured.

In step 310, a sensor (e.g., one of the sensors 110 of FIG. 2) measures an environmental parameter. This parameter may be a measured parameter such as the color, intensity, or distribution of light derived from a lighting system, temperature or humidity in the area of the chair, or the presence of a sound level for a particular sound (e.g., a masking sound (white noise)), or a particular musical composition.

The parameter is analyzed to see that it is appropriate for a given state of the chair. For instance, assume that sensors detect that Paul occupies the chair by using one of the techniques described above (e.g., by detecting or measuring Paul's weight or heartbeat characteristics). If Paul's preferred temperature setting is 20 C, then the measured parameter is "OK" if it is 20 C or within a fixed range of deviation from 20 C (e.g., say 19 C to 21 C). In this instance, if the measured parameter is outside of the desired range (e.g., say 18 C), then adjustment is required.

If the measured environmental parameter is "OK", then the process ends. If the parameter needs adjustment, then in step 315 the communications device (e.g., a component of the chair system 215 of FIG. 2) initiates an exchange of communications with the communications device 230 of the remote systems 225 of FIG. 2. A request is sent by the wireless communications devices.

In step 325, the receiving communications device notifies the remote computing system that a request has been made to adjust one or more environmental parameters.

Then, in step 335, an effector of the remote system is instructed by the computing system to adjust the parameter.

While the process may end with the adjustment (e.g., step 335), it is also desirable to check that the parameter has been adjusted properly. Thus, the steps may be reversed.

That is, after the parameter is adjusted in step 335, the computing system is notified in step 325, communications are exchanged between the remote systems and the chair systems in step 315 so that the environmental parameter may be measured and analyzed again in step 310.

Optionally, if the state indicates that an occupant or a particular occupant is present in the chair, then information may be conveyed to the occupant (e.g., a request for an adjustment of an environmental parameter has been requested or that the adjustment has been completed). Also, the occupant of the chair may adjust the setting for the environmental parameter and re-initiate step 310 of the process. To enable such an operation, the chair systems 215 may include a user interface for manual setting (e.g., manually adjusting) of desired environmental parameters. The user interface, the sensors 110, and communications device 130 of the chair systems 215 of FIG. 2 may be integrated into the functions of a computing system such as may be implemented by a personal computer.

Thus, with the unique and unobvious aspects of the present invention, the seating platform can sense the occupation of the chair, transmit an indication of the occupation wirelessly to a computing system, and enable the computing system to actuate effectors to change the environment of the chair.

Moreover, the electronically-equipped chair can be connected to a network so that information about the state of the chair and its occupant may be relayed to others at distant locations.

Additionally, with the inventive structure, energy is provided to the electronics carried by the chair so as to allow the chair to remain mobile without the need for wired connections, and moreover the need for replacement of batteries for supplying energy to the chair devices, may be eliminated.

While the invention has been described in terms of several preferred embodiments, those skilled in the art will recognize that the invention can be practiced with modification within the spirit and scope of the appended claims.

What is claimed is:

1. A system, comprising:

a seating platform;

a communications system embedded within said seating platform for receiving an information carrying communication from a remote system; and a haptic system embedded in said seating platform for communicating information carried by said information carrying communication to an occupant of said seating platform, wherein said communications system comprises a wireless communications system, wherein said seating platform is mobile, wherein said haptic system comprises a plurality of vibrators disposed at a plurality of positions in the seating platform for communicating information to said occupant of said seating platform, wherein said haptic system comprises a plurality of deformable surfaces disposed at a plurality of positions in the seating platform for communicating information to said occupant of said seating platform, wherein a predetermined combination of said plurality of vibrators communicates information to said occupant, wherein a predetermined combination of said plurality of deformable surfaces communicates information to said occupant, and wherein a predetermined combination of said plurality of vibrators and said plurality of deformable surfaces communicates information to said occupant.

* * * * *